United States Patent [19]

Sano

[11] 3,997,061

[45] Dec. 14, 1976

[54] TOY CRANE

[75] Inventor: Hiroshi Sano, Tokyo, Japan

[73] Assignee: Tomy Kogyo Co., Inc., Tokyo, Japan

[22] Filed: June 25, 1975

[21] Appl. No.: 590,060

[30] Foreign Application Priority Data

July 3, 1974 Japan ..... 49-78418[U]

[52] U.S. Cl. ..... 212/63; 212/28; 46/37

[51] Int. Cl.[2] ..... B66C 23/02

[58] Field of Search ..... 212/28, 12, 32, 26, 212/124–125, 138, 66–68, 61–63; 46/37; 214/87

[56] References Cited

UNITED STATES PATENTS

| | | | |
|---|---|---|---|
| 1,762,459 | 6/1930 | Wolf | 212/68 X |
| 2,020,802 | 11/1935 | Sauer | 212/68 X |
| 2,610,527 | 9/1952 | Papay | 212/68 X |
| 2,828,872 | 4/1958 | Mangel | 212/63 X |
| 3,074,562 | 1/1963 | Clayborne et al. | 212/63 X |
| 3,076,559 | 2/1963 | Crile | 212/63 |
| 3,870,161 | 3/1975 | Cording | 212/63 X |

FOREIGN PATENTS OR APPLICATIONS

| | | | |
|---|---|---|---|
| 318,739 | 9/1929 | United Kingdom | 212/68 |

*Primary Examiner*—Robert J. Spar
*Assistant Examiner*—R. B. Johnson

[57] ABSTRACT

A toy crane provided with a base, a tower extending upwardly therefrom, a boom mounted to rotate about the tower, a carriage mounted to travel along the boom, an implement that may be raised and lowered from the carriage, and a control station permitting the child to select any one of three modes of operation, namely, rotation of the boom in a horizontal plane, raising and lowering of the implement with respect to the carriage, and movement of the carriage along the boom, and thereafter perform the selected operation by turning a hand crank mechanism. As an integral part of the toy crane mechanism there is provided a reciprocally mounted spur gear that is arranged to assume three distinct positions corresponding to the modes of operation, the spur gear forming an integral part of separate gear train systems operable by the crank mechanism for performing the above-noted functions.

4 Claims, 8 Drawing Figures

TOY CRANE

BACKGROUND OF THE INVENTION

The present invention relates to a toy crane permitting a wide variety of functions to be performed in simple manner by the child.

With the present invention, it is possible for the child to rotate the boom through 360°, raise and lower the working implement and to move the implement outwardly and inwardly along the boom. Moreover, the separate functions may be performed by a structure characterized by its simplicity and reliability of use.

DESCRIPTION OF THE PREFERRED EMBODIMENT

Figure 1:
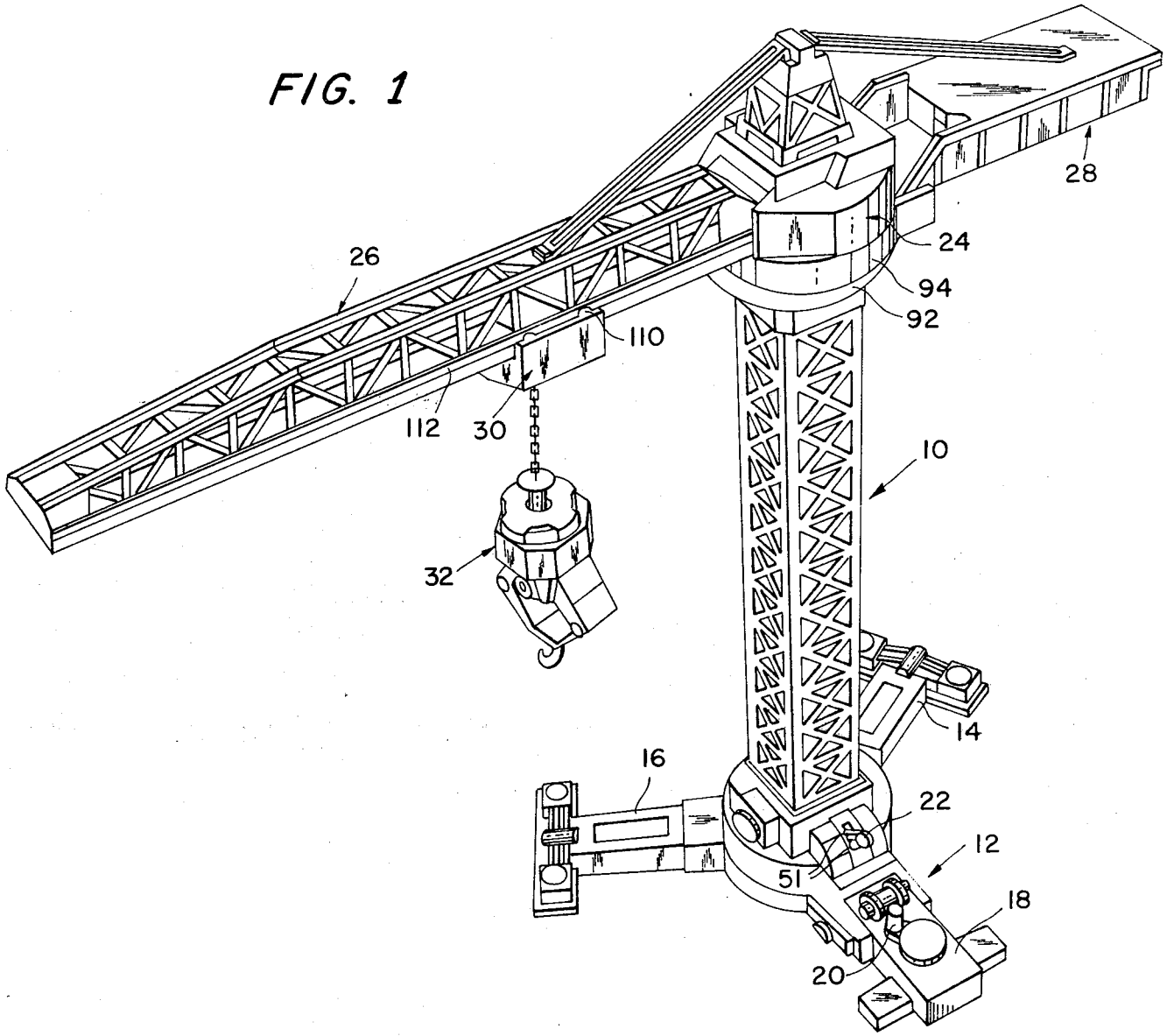
FIG. 1 is a perspective view of the toy crane.

As illustrated in FIG. 1, the toy crane of the present invention comprises an upstanding tower 10 suitably mounted upon a pedestal base 12 provided with three outstanding legs 14, 16 and 18. As will be apparent, the leg 18 is provided with a control panel comprising a rotatably mounted knob 20 and an operating lever 22. Suitably mounted upon the top of the tower 10 is a housing 24 from which outwardly extends on one side thereof the working boom 26 and from which outwardly extends on the other side thereof the counter balancing arm 28. Mounted for sliding along the underneath side of the working boom 26 is a carriage 30 from which the working implement 32 is suspended.

As will be explained in detail hereinafter, rotation of the knob 20 causes the boom 26 to rotate in a horizontal plane about the tower 10 when the lever 22 is set in a first position. Movement of the lever 22 to a second position followed by rotation of the knob 20 by the child causes the carriage 30 to move outwardly and inwardly along the boom 26 positioning the working implement 32 at a predetermined distance from the tower 10. Further movement of the operating lever 22 to a third position followed by rotation of the knob 20 raises and lowers the working implement 32 with respect to the carriage 30. In this manner, all necessary operating functions are performed simply by rotating the knob 20 after the operating lever 22 has been set in the desired position.

Figure 2:
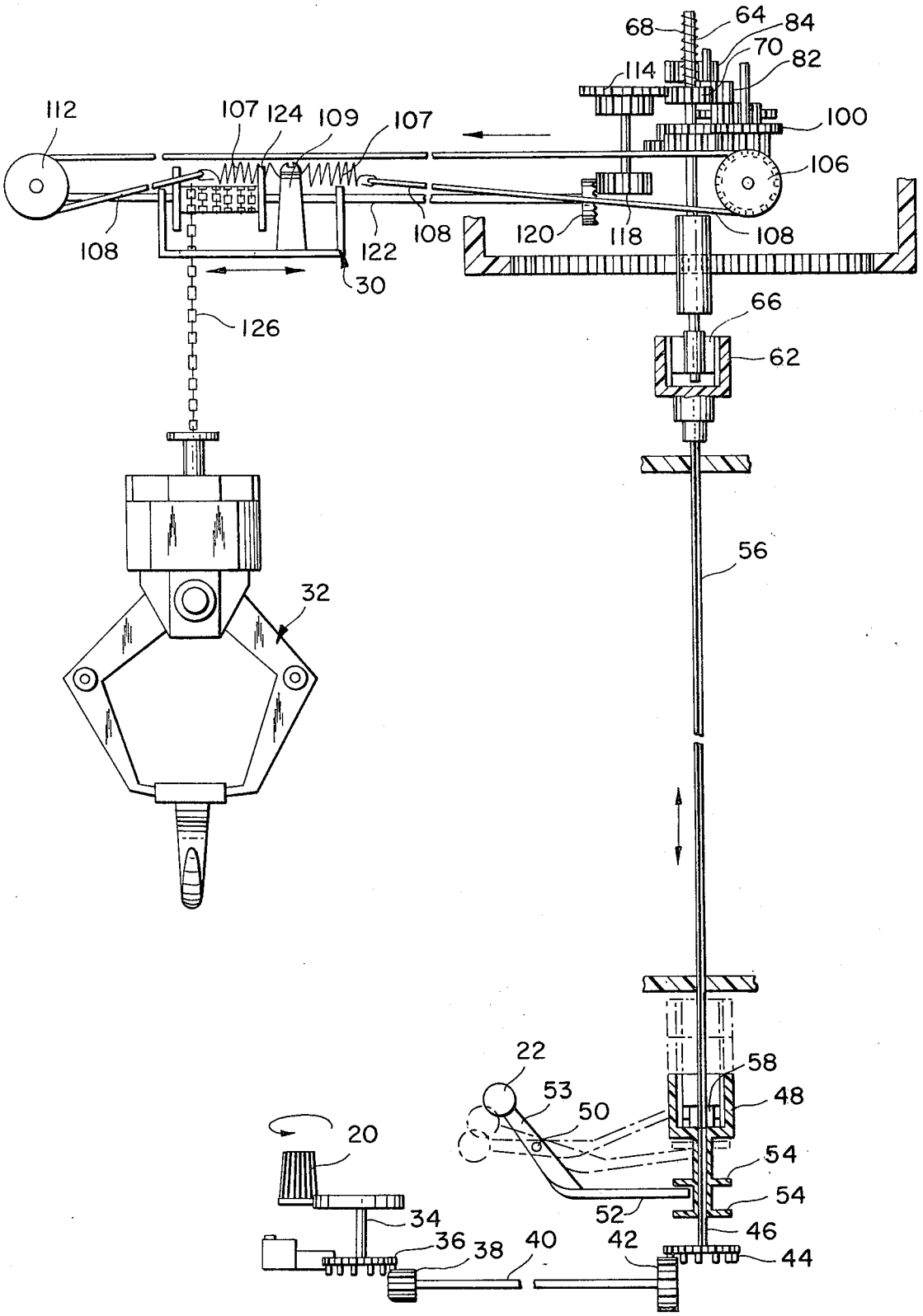
FIG. 2 is a fragmentary cross-sectional view of the crane illustrating only the operating mechanism for permitting the crane to rotate throughout 360°, extending and retracting the carriage along the underneath surface of the boom, and raising and lowering the working implement with respect to the carriage.
Figure 5:
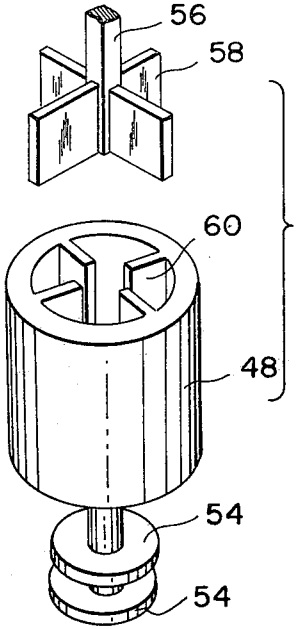
FIG. 5 is an exploded perspective view of the connecting elements between the operating lever and the shaft that passes upwardly within the tower whereby the spur gear is permitted to assume the aforementioned distinct positions.

Reference is now made to FIG. 2 which discloses the operating mechanism of the toy crane and wherein it will be apparent that not effort has been made to illustrate how the various shafts of the gearing mechanisms and related structures are journalled within or otherwise attached to the chassis of the tower 10, pedestal 12, housing 24, working boom 26 and carriage 30. It will be apparent that the knob 20 is suitably mounted to a shaft 34 that is appropriately journalled with the leg 18. The shaft 34 is provided with a gear 36 which meshes with a gear 38 fixedly secured to a shaft 40 also appropriately journalled within the leg 18 and which terminates at the other end thereof in a gear 42 which meshes with a gear 44 which is located at the lower end of the shaft 46 which is square in cross-section. The shaft 46 passes through a corresponding square opening provided within the connecting element 48 which is illustrated in FIG. 5.

It will also be apparent that the operating lever 22 is mounted for rotation about a shaft 50 appropriately journalled within the leg 18 of the pedestal 12 and includes an arm 52 which is positioned between the flanges 54 of the connecting element 48. Thus, as the operating lever 22 is moved about the shaft 50 the connecting element 48 is raised and lowered. It is to be understood that three notches 51 are provided in the leg 18, as illustrated in FIG. 1, within which the arm 53 of the operating lever 22 may be positioned in such manner as to define three separate positions of the operating lever 22, as will be explained in detail hereinafter.

Passing upwardly through the interior of the tower 10 is a shaft 56 which is square in cross-section and which terminates at the bottom thereof in four arms 58 extending radially outward therefrom. It will be apparent from FIG. 5 that the arms 58 are confined within the segments defined by the corresponding arms 60 located within the connecting element 48. Thus, movement of the operating lever 22 raises and lowers the connecting element 48 in turn raising and lowering the shaft 56 within the upstanding tower 10. The top of the shaft 56 is provided with a connecting element designated by the reference numeral 62 and which is also provided with inwardly extending arms similar to those designated by the reference numeral 60 in the connecting element 48.

It will be apparent from FIG. 2 that a shaft 64 is appropriately journalled within the housing 24 for reciprocating movement. The shaft 64 terminates at its bottom in outwardly extending arms 66 which fit within the slots defined by the arms of the connecting element 62. In this maner, rotation of the shaft 56 within the tower 10 is directly translated to rotation of the shaft 64 within the housing 24.

Figure 4C:
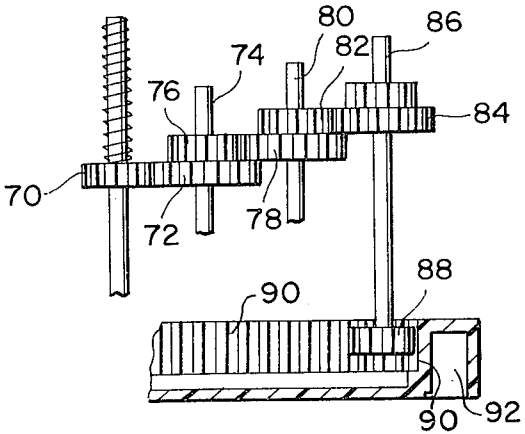
FIG. 4C is a fragmentary cross-sectional view illustrating a third position of the reciprocally mounted spur gear responsible for rotating through a gear mechanism the boom of the crane through 360° about the upstanding tower of the crane.
Figure 6:
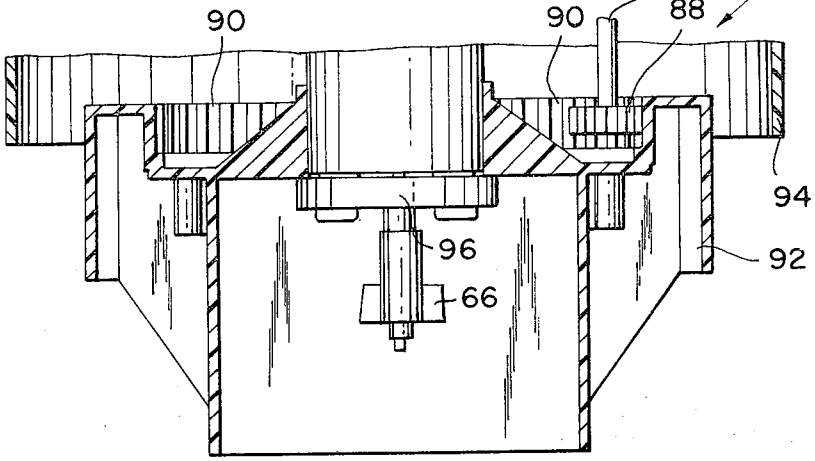
FIG. 6 is a cross-sectional view taken along line 6—6 of FIG. 3 with the gearing system removed illustrating the system for mounting the upper section of the housing for rotation about the stationary, lower section so as to permit the boom to rotate about the tower.

When it is desired to rotate the boom 26 in a horizontal plane about the tower 10, the operating lever 22 is positioned such that the arm 52 is in its lowermost position, as illustrated in solid lines in FIG. 2. It should be noted that a coil spring 68 is interposed between the spur gear 70 which is rigidly secured to the shaft 64 and the top of the housing 24 through which the shaft 64 is appropriately journalled. The purpose of the spring 68 is to normally urge the spur gear 70, and thus the shaft 64, downwardly to their lowermost position. It will be apparent from FIG. 4C that the spur gear 70 in its lowermost position is aligned to mesh with a gear 72 which is mounted upon a shaft 74 which is also provided with a gear 76 that meshes with a gear 78 that is appropriately mounted on a shaft 80 which, in turn, if provided with a gear 82 that meshes with a gear 84 mounted upon a shaft 86. It will be apparent that the shafts 74, 80 and 86 are appropriately journalled within the housing 24 for rotation. The shaft 86 terminates downwardly in a gear 88 having teeth that mesh with the teeth 90 of a continuous rack extending along the entire periphery of the lower section 92 of the housing 24 which is rotatably mounted with respect to the upper section 94 by the flange 96, as illustrated in FIG. 6. It will now be apparent that as the child rotates the knob 20, shafts 40, 46, 56 and 64 are caused to rotate in turn causing the rotating spur gear 70 to rotate the gears 72, 78, 84 and 88 in turn causing the upper section 94 of the housing 24 to rotate in relationship to the stationary lower section 92 in turn causing the boom 26 to rotate about the tower 10. The direction of rotation of the boom 26 is determined by the direction of rotation of the knob 20.

Figure 3:
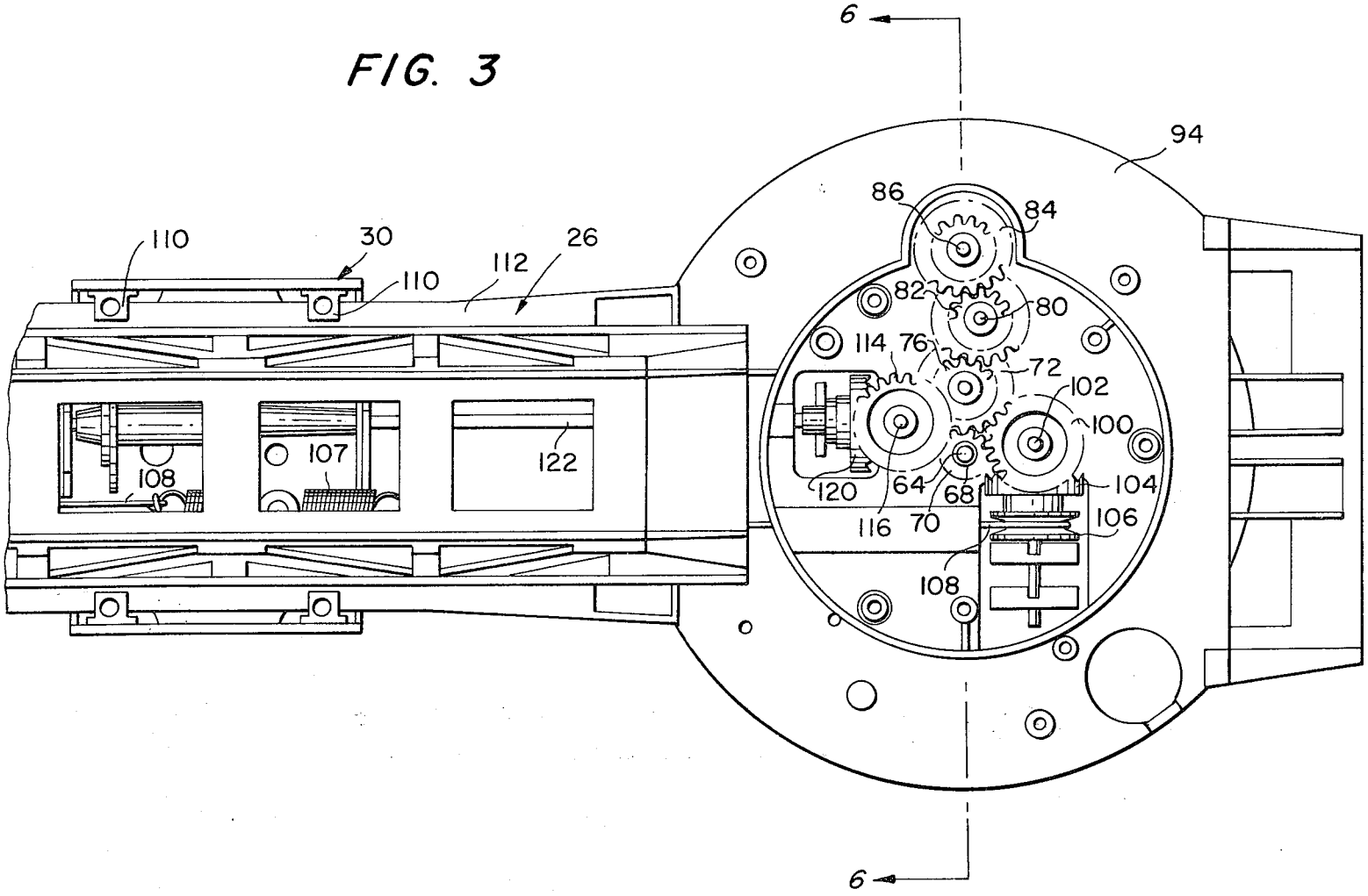
FIG. 3 is a fragmentary top plan view of the toy crane with a portion of the housing removed so as to illustrate the relationship of certain of the gearing mechanisms for performing the aforementioned functions.
Figure 4B:
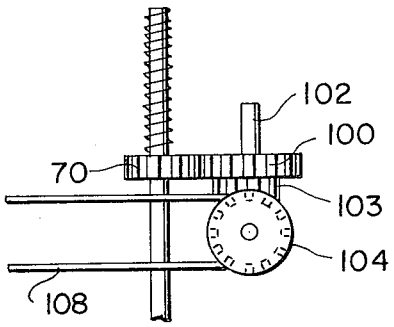
FIG. 4B is a fragmentary cross-sectional view illustrating a second position of the reciprocally mounted spur gear responsible for moving through a pulley system the carriage, from which the working implement is suspended, outwardly and inwardly along the boom of the crane.

When it is desired to move the carriage 30 and implement 32 suspended therefrom outwardly and inwardly along the boom 26, the operating lever 22 is adjusted to the intermediate position, illustrated in dotted lines in FIG. 2, wherein it will be apparent that the shafts 56 and 64 are moved upwardly until the spur gear 70 engages the gear 100, as illustrated in FIG. 4B, which is mounted to the shaft 102 which is appropriately journalled within the housing 24. Rotation of the spur gear 70 by turning the knob 20, which has previously been described, rotates the gear 100 which causes the teeth of the smaller integrally formed gear 103 to mesh with the teeth of the gear 104 which is attached to a pulley 106, as illustrated in FIG. 3, around which a line 108 passes. It will be noted that the carriage 30 is provided with separate coil springs 107 attached at first ends to the upstanding post 109 formed as an integral part of the carriage 30 and at the opposite ends to the line 108. As can be seen in FIG. 3, the carriage 30 is provided with abutments 110 which ride on the rails 112 formed along the sides of the boom 26. As illustrated in FIG. 2, a second pulley 112 is mounted at the end of the boom 26. Thus, as the pulley 106 is rotated by the gear 104, the carriage 30 traverses the boom 26. By rotating the knob 20 in one direction the carriage 30 moves outwardly along the boom 26 while rotating the knob 20 in the opposite direction moves the carriage 30 inwardly towards the tower 10.

Figure 4A:
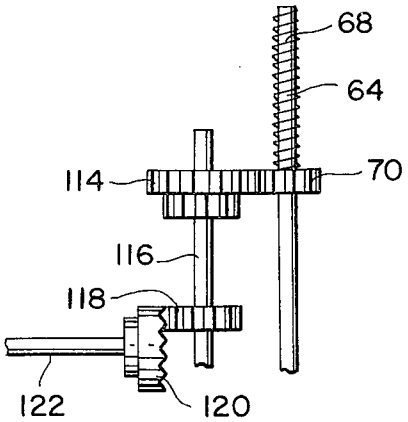
FIG. 4A is a fragmentary cross-sectional view illustrating a first position of the reciprocally mounted spur gear responsible for rotating through a gear mechanism a rod passing through the boom of the crane for winding the chain to which the working tool or implement is attached on a drum for raising and lowering the working implement.

When it is desired to raise or lower the implement 32, the operating lever 22 is adjusted such that the arm 52 is in the uppermost position, illustrated in dotted lines in FIG. 2, at which time the spur gear 70 is aligned with the gear 114, as illustrated in FIG. 4A, which is mounted to the shaft 116 which is journalled within the housing 24. At the other end of the shaft 116 is a gear

118 which meshes with a gear 120 which is located at one end of the shaft 122. The shaft 122 runs the entire length of the boom 26, as illustrated in FIG. 2, and is appropriately journalled at the far end thereof. A spool 124 is rigidly secured to the shaft 122, and the chain 126, which is attached to the implement 32, is attached to and wound around the spool 124. Thus, as the child turns the knob 20 the rotation of the shafts 40, 46, 56 and 64 causes the spur gear 70 to rotate the gear 114 rotating the shaft 116 in turn causing the rotating gear 118 to rotate the gear 120 in turn rotating the shaft 122 which is responsible for rotating the spool 124. Rotation of the knob 20 in one direction rewinds the chain 126 about the spool 124 causing the implement 32 to rise, whereas rotation of the knob 20 in the opposite direction unwinds the chain 126 lowering the implement 32.

I claim:

1. A toy crane, comprising:

a base, a tower supported by the base and extending upwardly therefrom;

a boom mounted on said tower to rotate in a plane about said tower;

a carriage mounted to travel along said boom;

an implement suspended from said carriage for movement up and down with respect to said carriage;

a control station mounted on said base comprising a knob mounted for rotation and a lever operable between three positions; and an operating system within said tower comprising, a vertical shaft, a gear mounted to a said shaft for rotation therewith, said gear and shaft also being mounted and actuated by said lever for reciprocating up and down movement between three positions corresponding to said three positions of said lever, means operatively connecting said knob to said shaft for rotating said shaft, first gear means connected to said boom for rotating said boom when selectively driven by said gear in a first of said three positions, second gear means connected to said carriage for moving said carriage along said boom when selectively driven by said gear in the second of said three positions, and third gear means connected to said iimplement for moving said implement with respect to said carriage when selectively driven by said gear in the third of said three positions.

2. A toy crane as in claim 1, including a housing having an upper portion to which said boom is mounted and a lower portion secured to said tower and provided with a continuous rack of teeth, means mounting said upper portion to rotate about said lower portion, and wherein said first gear means comprises a gear train mounted within said upper portion and including at least a first gear driven by said gear and a second gear meshing with said continuous rack of teeth of said lower portion.

3. A toy crane as in claim 1, including a first pulley rotationally mounted within said boom remote from said tower, a second pulley mounted for rotation by said second gear means, and a line wound on said pulleys and having the ends thereof secured to said carriage for moving said carriage along said boom.

4. A toy crane as in claim 1, including a shaft mounted for rotation along said boom, a spool mounted to said shaft, a line attached to said spool, wound around said spool and attached at the other end to said implement, said shaft being rotated by said third gear means.

* * * * *